US009226553B2

(12) United States Patent
Husar et al.

(10) Patent No.: US 9,226,553 B2
(45) Date of Patent: Jan. 5, 2016

(54) GEMSTONE CUT WITH IMPROVED CHARACTERISTICS

(75) Inventors: Michael C. Husar, West Bend, WI (US); Marvin J. Husar, West Bend, WI (US); Mildred H. Husar, legal representative, West Bend, WI (US)

(73) Assignee: 4 MH Advertising, LLC, West Bend, WI (US)

( * ) Notice: Subject to any disclaimer, the term of this patent is extended or adjusted under 35 U.S.C. 154(b) by 0 days.

(21) Appl. No.: 13/433,591

(22) Filed: Mar. 29, 2012

(65) Prior Publication Data

US 2012/0297826 A1 Nov. 29, 2012

Related U.S. Application Data

(60) Provisional application No. 61/491,059, filed on May 27, 2011.

(51) Int. Cl.
*A44C 17/00* (2006.01)

(52) U.S. Cl.
CPC ..... *A44C 17/001* (2013.01)

(58) Field of Classification Search
CPC ..... A44C 17/00; G01N 21/87
USPC ..... 63/32
See application file for complete search history.

(56) References Cited

U.S. PATENT DOCUMENTS

| | | | | |
|---|---|---|---|---|
| 5,713,219 | A * | 2/1998 | Itzkowitz | 63/26 |
| D453,007 | S | 1/2002 | Asscher | |
| 6,761,044 | B2 | 7/2004 | Samuels | |
| D506,946 | S | 7/2005 | Ishii | |
| 7,000,607 | B2 | 2/2006 | Davidi | |
| 7,146,827 | B2 | 12/2006 | Mardkha | |
| 7,193,694 | B2 * | 3/2007 | Underwood | 356/30 |
| D582,816 | S | 12/2008 | Yuan | |
| D583,703 | S | 12/2008 | Yuan | |
| D599,696 | S | 9/2009 | Yuan | |
| D639,202 | S * | 6/2011 | Gavin | D11/90 |

* cited by examiner

*Primary Examiner* — Jack W Lavinder
(74) *Attorney, Agent, or Firm* — Brannen Law Office, LLC

(57) ABSTRACT

A gemstone cut is provided with a strategic placement of facets that optimizes the three dimensional optically geometric light interactions to thereby produce unique characteristics. In one embodiment, the gemstone has a crown with 29 facets, a pavilion with 28 facets and a girdle with 32 facets. The crown has a table with an octagonal shape, four first star facets, four second star facets, eight kite facets, eight first upper girdle facets and four second upper girdle facets. The pavilion can have eight pavilion facets, eight intermediate pavilion facets, eight first lower girdle facets and four second lower girdle facets. The girdle can have 32 facets including four sides each having seven facets and four facets at the corners of the gemstone interspaced between the side facets. The gemstone has four-fold mirror-image symmetry.

3 Claims, 12 Drawing Sheets

GEMSTONE CUT WITH IMPROVED CHARACTERISTICS

This United States utility patent application claims priority on and the benefit of provisional application 61/491,059 filed May 27, 2011, the entire contents of which are hereby incorporated herein by reference.

BACKGROUND OF THE INVENTION

1. Field of the Invention

The present invention relates to gemstones and, more particularly, to a unique cut for improving the gemstone's light performance including brightness, scintillation and dispersion.

2. Description of the Related Art

The quality of a gemstone such as a diamond is partially dependent upon the cut of the facets which reflect the brilliance, fire, sparkle and luster of a diamond. Facets are the smooth surface areas of a gemstone which have been cut, polished and positioned at different angles (slope and azimuth) which allow light to enter and reflect back from the gemstone. The depth and width and the uniformity of the facets control the brilliance and the durability of a gemstone. The quality of the facets are the major determining factor in enhancing a gemstone's ability to sparkle or reflect light and play a large part in the resulting brilliance of the gemstone. The following general definitions will help with understanding diamond facets.

Brilliance is the amount of sparkle a gemstone gives off through the reflection and refraction of light. Light enters the gemstone through the crown, hits one pavilion side, bounces to the opposite pavilion side and then is reflected back through the crown to the viewer. All facets must support the critical angle in order to achieve this light interaction. Failure to work around the critical angle will cause light entering the crown to exit the stone through the pavilion, instead of through the crown, resulting in a dark and dull stone. Exiting through the pavilion is termed leakage.

Sparkle is a measure of the light reflected out by a gemstone as it is viewed from different angles.

Dispersion, also known as fire, refers to the prism of light refracted from within a cut and polished gemstone and relates to the sparkling colors that are emitted from the stone as it is viewed from different angles. Dispersion is based upon the refractive index, a measure of the degree to which light bends as it passes from air to the stone. Diamonds have one of the highest refractive indexes for natural transparent gemstones. Dispersion is influenced by the facet angles which control the manner in which light enters and exits the gemstone, the number of internal facets in the stone design and the number of times the light rays spread across the facet junctions of the stone. These factors directly affect the fire produced by a finished diamond and thus dispersion is also affected by the manner in which the stone is cut and the angles employed in that cut.

Fluorescence is an inherent property possessed by diamonds resulting in glowing without an appreciable rise of temperature when exposed to ultra-violet rays, cathode rays, etc.

Luster is used to describe the brightness of an object that shines with reflected light rather than producing its own.

Scintillation occurs when light bounces among the facets creating a sparkling display. Good examples of scintillating diamonds are commonly found in round brilliant cuts. They display an eight-pointed star, radiating from the culet when viewed from the table. Optimal scintillation displays a pleasing even pattern of white flashes that results from proper facet symmetry. This is created by light areas turning dark and vice versa, in which dark areas are created by the observer/viewer obscuring light in the angular range from 75 to 90 degrees. The scintillation effect occurs when the diamond moves, the observer/viewer moves or the light source moves causing facets to alternate from illuminated to obscured or light to dark in varied intensities.

Culet is a tiny flat facet that cutters sometimes add to the bottom of a diamonds pavilion to protect the tip of the pavilion from being chipped or damaged.

Cut, including the facet arrangement, is the human contribution to a gemstones beauty and directly affects the qualities of brilliance, scintillation and dispersion. Modern diamond cuts are the result of hundreds of years of study and experimentation on how to best display these unique features of gemstones. From a business standpoint, it is desirable to create new and recognizable cuts for the discerning buyer as a diamond must stand out as a stylish alternative to traditional cuts in order to attract buyers. As a result, several cuts that most effectively optimize brilliance, scintillation and dispersion have become industry standards. Traditional gemstone cuts may be classified into three general categories: the brilliant cut, the step cut, the hybrid or mixed cut.

The brilliant cut is traditionally used to create a round cut stone. It employs triangular facet patterns that radiate from the central table facet towards the girdle edge. The pavilion mains radiate from the cutlet towards the girdle edge. This arrangement produces maximum brilliance, forcing all of the light that enters the crown to be reflected and refracted back through the crown. As such, the brilliant cut maximizes the fire, thereby producing a highly recognizable and marketable stone. Many variations of the brilliant cut exist.

A step cut is a rectangular or square shaped cut. The crown is formed of three concentric rows of trapezoidal facets cut parallel to the girdle and radiating outward from an octagonally shaped table facet having beveled corners. There are two pairs of opposing pavilion sides and four pavilion corners. The pavilion also has three concentric rows or steps between the girdle and the cutlet, each step consisting of eight trapezoidal facets cut parallel to the girdle.

Hybrid or mixed cuts employ a combination of brilliant and step cuts to achieve the classic look of a step cut stone with the brilliance and dispersion closer to that of a brilliant cut stone.

Turning now to a few examples, United States Patent Number ("U.S. Pat. No.") 7,146,827 to Mardkha is titled Mixed Cut Gemstone. It illustrates a mixed cut gemstone comprising a girdle, a crown above the girdle and a pavilion below the girdle. The crown has a girdle break, a table break and a table. The table break is cut with triangular shaped facets and the girdle break is cut with triangular and quadrilaterally shaped facets. The present invention also describes a pavilion having a width and a length formed by two pairs of opposing pavilion sides and four pavilion corners. The pavilion is composed of four steps including: a first step descending from said girdle to a first step facet junction, a second step descending from said first step facet junction to a second step facet junction, a third step descending from said second step facet junction to a third step facet junction, and a fourth step descending from said third step facet junction to said culet.

U.S. Pat. No. 7,000,607 to Davidi is titled Gemstone and Corresponding Method of Cutting. It shows a gemstone having a crown, a girdle and a pavilion, wherein the girdle is shaped such that, when viewed in plan view, it is primarily bounded by four pairs of parallel straight edges. Three of the four pairs of edges are spaced by roughly equal spacing D.sub.1, while the remaining pair of edges is spaced by a spacing D.sub.2, wherein D.sub.2 is greater than D.sub.1 by between 10% and 40%. Also provided is a method for cutting such a gemstone.

U.S. Pat. No. 6,761,044 to Samuels is titled Gemstone Cut. It illustrates a gemstone cut comprising a crown, a girdle, and a pavilion, wherein the gemstone includes precious gemstones (such as diamonds) and semi-precious gemstones. The crown includes an octagonal table, which is surrounded by eight triangular star facets. Eight table bezels are disposed in-between the star facets and eight mid-bezels are disposed in-between the table bezels. Furthermore, the gemstone's pavilion has eight concentrically arranged culet pavilion facets, a girdle pavilion facet and a bottom small break facet that are disposed in-between the culet pavilion facets. The gemstone's girdle has eight left top half facets and eight right top half facets (located in-between the girdle bezels of the crown), and eight left bottom half facets and eight right bottom half facets (disposed in-between the girdle pavilion facets and bottom small break facets).

U.S. Pat. No. D506,946 to Ishii is titled Brilliant Gemstone, and shows an ornamental design of the gemstone.

A need exists for a gemstone cut that provides improved light returning out of the crown with limited leakage through the pavilion.

A need also exists for a gemstone cut that provides improved optical effects including brightness, scintillation and dispersion.

Thus, there exists a need for gemstone cut with improved characteristics that solves these and other problems.

SUMMARY OF THE INVENTION

The present invention relates to gemstones and, more particularly, to a unique cut for improving the gemstone's light performance including brightness, scintillation and dispersion.

A gemstone cut is provided with a strategic placement of facets that optimizes the three dimensional optically geometric light interactions to thereby produce unique characteristics. In one embodiment, the gemstone has a crown with 29 facets, a pavilion with 28 facets and a girdle with 32 facets. The crown has a table with an octagonal shape, four first star facets, four second star facets, eight kite facets, eight first upper girdle facets and four second upper girdle facets. The pavilion can have eight pavilion facets, eight intermediate pavilion facets, eight first lower girdle facets and four second lower girdle facets. The girdle can have 32 facets including four sides each having seven facets and four facets at the corners of the gemstone interspaced between the side facets. The gemstone has four-fold mirror-image symmetry.

The gemstone cut can be applied to a variety of gemstones including but not limited to diamonds.

According to one advantage of the present invention, the gemstone cut provides improved light performance, including increased amounts of light returning out from the crown and reduced leakage through the pavilion. This is illustrated herein in the figures depicting the ray tracing images.

According to another advantage of the present invention, the gemstone cut provides improved optical effects including brightness, scintillation and dispersion. This is illustrated herein in the figure depicting the ASET image.

Other advantages, benefits, and features of the present invention will become apparent to those skilled in the art upon reading the detailed description of the invention and studying the drawings.

BRIEF DESCRIPTION OF THE DRAWINGS

FIG. 16 is similar to. FIG. 15, but additionally shows light that is gathered by intensity by the present invention.

DETAILED DESCRIPTION OF PREFERRED EMBODIMENTS

Figure 1:
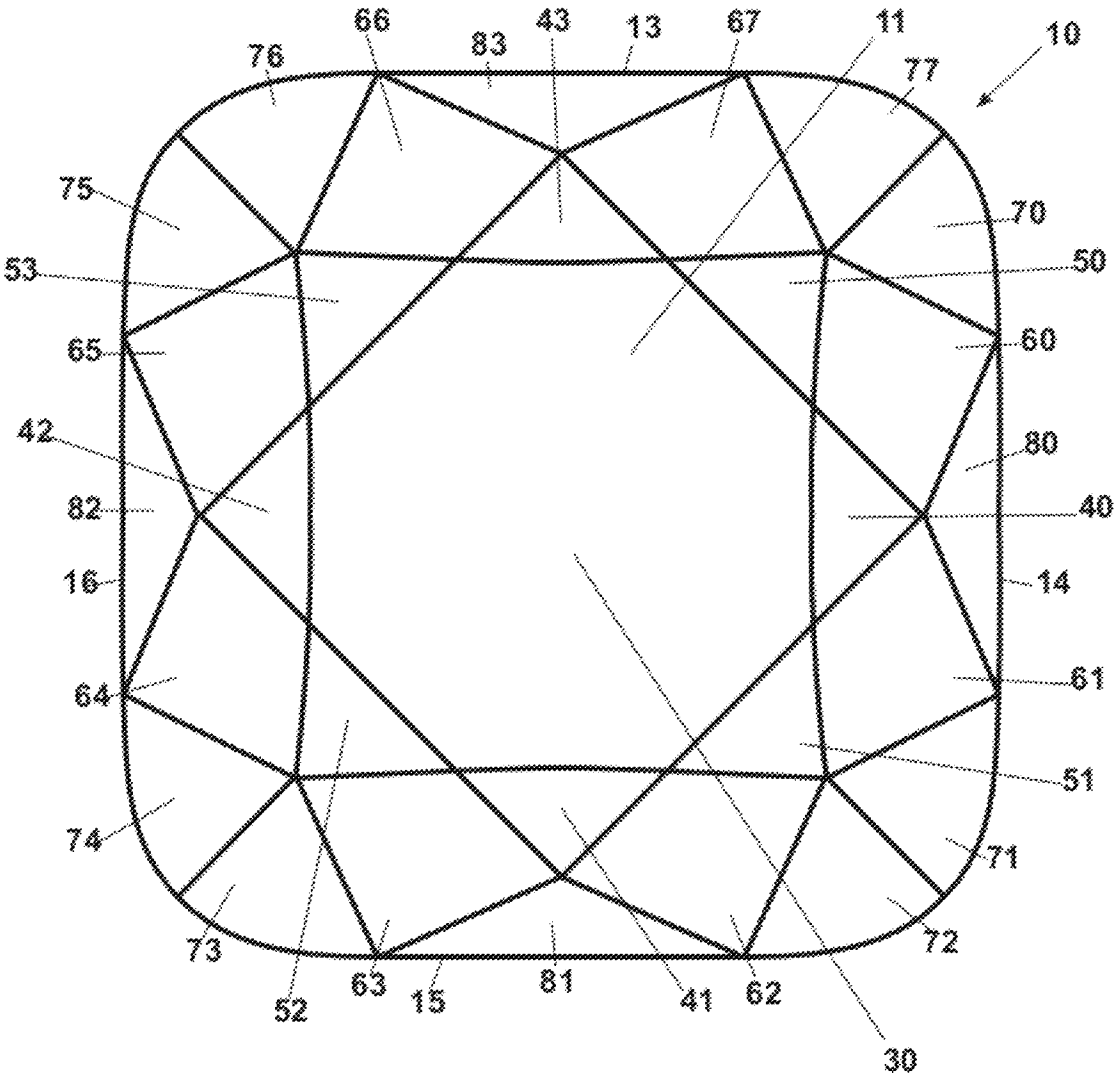
FIG. 1 is a top view of an embodiment of a gemstone cut of the present invention.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Turning now to FIGS. 1-6, it is seen that a preferred embodiment of the present invention is illustrated. The gemstone 10 has a top 11, a bottom 12, and four sides 13, 14, 15 and 16. The gemstone 10 has a crown 20, a pavilion 100 and a girdle 160. One preferred gemstone is a diamond. Yet, it is appreciated that other gemstones or even items that are not gemstones may be formed to the proportions illustrated herein without departing from the broad aspects of the present invention. The crown 20, pavilion 100 and girdle 160 are discussed below.

It is appreciated that many angles are provided herein and are exemplary of a preferred embodiment of the present invention. The angles and shapes may deviate or change a small amount without departing from the broad aspects of the present invention. For example, it may be preferred to change the shape, slope and/or azimuth slightly when cutting a particular stone so as to specifically include or exclude certain features of the stone to determine what is included and/or excluded from the finished gemstone.

Tuning now specifically to FIG. 1, it is seen that the crown 20 has 29 facets. The first facet is a table facet 30, which is preferably octagonal in shape and is centrally located on the crown. The table facet 30 has a slope of 0 degrees and an azimuth of 0 degrees.

The crown 20 further has four first star facets 40, 41, 42 and 43, respectively. Each of the first star facets is at a slope angle of 16.81 degrees. Facet 40 has an azimuth of 44.50 degrees, facet has an azimuth of 314.50 degrees, facet 42 has an azimuth of 224.50 degrees and facet 43 has an azimuth of 134.50 degrees. The four first star facets are located equidistant around the table 30 at locations midway between the corners of the crown 20.

Four second star facets 50, 51, 52 and 53 are also provided. Each of the second star facets is at a slope of 16.81 degrees. Facet 50 has an azimuth of 89.50 degrees. Facet 51 has an azimuth of 359.50 degrees. Facet 52 has an azimuth of 269.50 degrees. Facet 53 has an azimuth of 179.50 degrees. The four second star facets are located equidistant around the table 30 in line with the corners of the crown. The first star facets 40, 41, 42 and 43 are spaced between the second star facets 50, 51, 52 and 53 in alternating fashion.

Each of the first and second star facets are adjacent the table, and in this regard the table is bounded by the first and second star facets.

Eight kite facets 60, 61, 62, 63, 64, 65, 66 and 67, respectively are further provided. Each kite facet has a slope of 27.09 degrees. Facet 60 has an azimuth of 67.00 degrees. Facet 61 has an azimuth of 22.00 degrees. Facet 62 has an azimuth of 337.00 degrees. Facet 63 has an azimuth of 292.00 degrees. Facet 64 has an azimuth of 247.00 degrees. Facet 65 has an azimuth of 202.00 degrees. Facet 66 has an azimuth of 157.00 degrees. Facet 67 has an azimuth of 112.00 degrees. The eight kite facets are spaced about the crown wherein they are arranged side to side. Each kite facet has four sides. Each kite facet has an interior point contacting the table, and the two sides adjacent this point contact one first star facet and one second star facet, respectively of adjacent facets.

Eight first upper girdle facets 70, 71, 72, 73, 74, 75, 76 and 77, respectively, are further provided. Each first upper girdle facet has a slope of 33.72 degrees. Facet 70 has an azimuth of 78.25 degrees. Facet 71 has an azimuth of 10.75 degrees. Facet 72 has an azimuth of 248.25 degrees. Facet 73 has an azimuth of 280.75 degrees. Facet 74 has an azimuth of 258.25 degrees. Facet 75 has an azimuth of 190.75 degrees. Facet 76 has an azimuth of 168.25 degrees. Facet 77 has an azimuth of 100.75 degrees. Two of the eight first upper girdle facets are located at each corner of the gemstone 10.

Four second upper girdle facets 80, 81, 82 and 83, respectively, are further provided. The four second upper girdle facets have a slope of 44.47 degrees. Facet 80 has an azimuth of 44.50 degrees. Facet 81 has an azimuth of 314.50 degrees. Facet 82 has an azimuth of 224.50 degrees. Facet 83 has an azimuth of 134.50 degrees. The four second upper facets are equally spaced around the perimeter of the crown and are located midway between the adjacent respective corners of the gemstone 10.

The first and second upper girdle facets are located between the kite facets and the girdle (described below).

Figure 2:
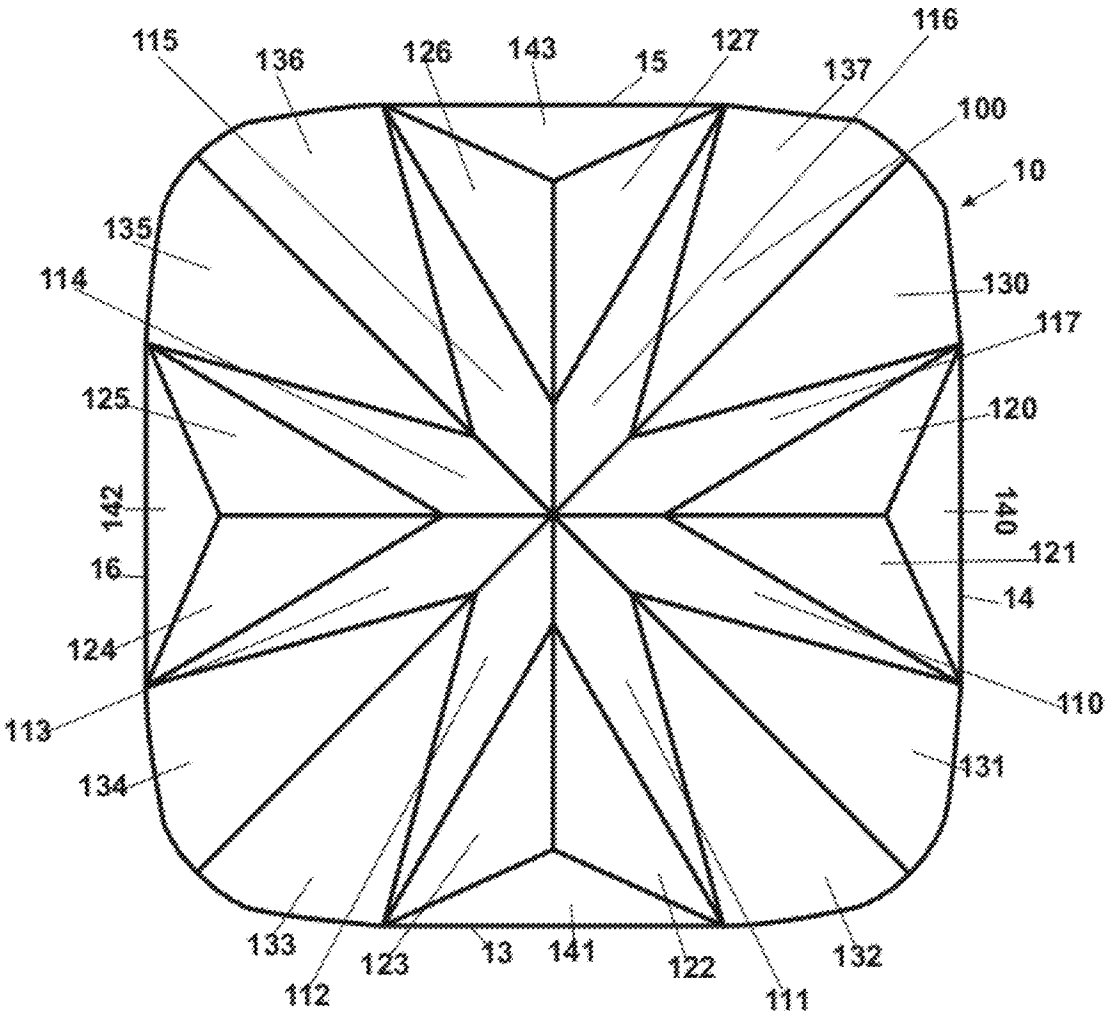
FIG. 2 is a bottom view of the embodiment of a gemstone cut illustrated in FIG. 1.

Turning now specifically to FIG. 2, it is seen that the pavilion 100 has 28 facets. The center point does not show a culet, but one can be provided without departing from the broad aspects of the present invention.

The pavilion 100 has eight primary pavilion facets 110, 111, 112, 113, 114, 115 116 and 117 (or simply pavilion facets). Facets 110, 112, 114 and 116 have slopes of 41.68 degrees, and facets 111, 113, 115 and 117 have slopes of 41.49 degrees. Facet 110 has an azimuth of 337.00 degrees. Facet 111 has an azimuth of 22.01 degrees. Facet 112 has an azimuth of 67.00 degrees. Facet 113 has an azimuth of 112.01 degrees. Facet 114 has an azimuth of 157.00 degrees. Facet 115 has an azimuth of 202.01 degrees. Facet 116 has an azimuth of 247.00 degrees. Facet 117 has an azimuth of 292.01 degrees. The eight pavilion facets are spaced equally about the pavilion. The eight pavilion facets respectively span between the pavilion midpoint and the girdle (described below).

The pavilion further has eight intermediate pavilion facets 120, 121, 122, 123, 124, 125, 126 and 127 respectively. Each intermediate pavilion facet has a slope of 42.89 degrees. Facet 120 has an azimuth of 303.25 degrees. Facet 121 has an azimuth of 325.75 degrees. Facet 122 has an azimuth of 33.25 degrees. Facet 123 has an azimuth of 55.75 degrees. Facet 124 has an azimuth of 123.25 degrees. Facet 125 has an azimuth of 145.75 degrees. Facet 126 has an azimuth of 213.25 degrees. Facet 127 has an azimuth of 235.75 degrees. The intermediate pavilion facets are arranged in pairs, wherein each pair is equally spaced about the pavilion and are located between the corners of the gemstone 10. Each pair of intermediate pavilion facets is bounded by two pavilion facets.

Eight first lower girdle facts 130, 131, 132, 133, 134, 135, 136 and 137 are further provided. Each first lower girdle facet has a slope of 42.89 degrees. Facet 130 has an azimuth of 280.75 degrees. Facet 131 has an azimuth of 348.26 degrees. Facet 132 has an azimuth of 10.75 degrees. Facet 133 has an azimuth of 78.26 degrees. Facet 134 has an azimuth of 168.26 degrees. Facet 135 has an azimuth of 190.75 degrees. Facet 136 has an azimuth of 190.75 degrees. Facet 137 has an azimuth of 258.26 degrees. The first lower girdle facets are arranged in pairs, wherein each pair is located in the corner of the gemstone 10 between the pavilion facets and the girdle (described below), and are equidistantly spaced about the pavilion.

Four second lower girdle facets 140, 141, 142 and 143, respectively, are further provided. The second lower girdle facets have a slope of 53.08 degrees. Facet 140 has an azimuth of 314.50 degrees. Facet 141 has an azimuth of 44.50 degrees. Facet 142 has an azimuth of 134.50 degrees. Facet 143 has an azimuth of 224.50 degrees. The four second lower girdle facets are equidistantly spaced about the perimeter intermediate corners of the gemstone 10. The four second lower girdle facets are bounded by the girdle (described below) and by the intermediate pavilion facets, respectively.

The girdle 160 has a total of 32 facets. Four sides, each having seven facets, as well as one facet in each of four gemstone girdle corners comprise the girdle. Each of the sides is described below.

Figure 3:
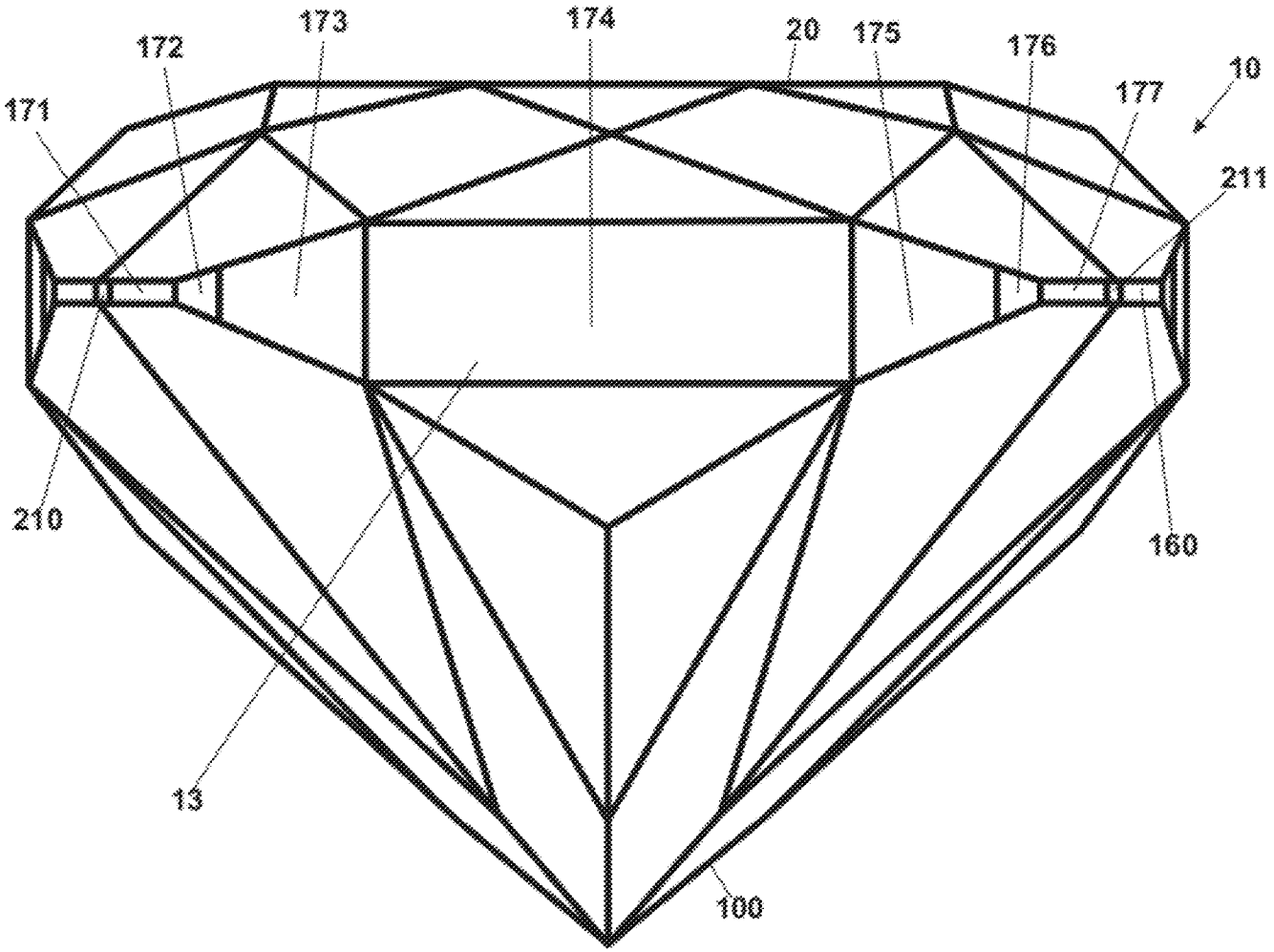
FIG. 3 is a first side view of the embodiment of a gemstone cut illustrated in FIG. 1.

Turning now to FIG. 3, it is seen that a girdle on one side 13 of the gemstone 10 is illustrated. Accordingly, girdle facet first sides 171, 172, 173, 174, 175, 176 and 177 are provided. The slope of the girdle facets are each 90.00 degrees. Facet 171 has an azimuth of 280.75 degrees. Facet 172 has an azimuth of 303.25 degrees. Facet 173 has an azimuth of 308.88 degrees. Facet 174 has an azimuth of 314.50 degrees. Facet 175 has an azimuth of 320.11 degrees. Facet 176 has an azimuth of 325.75 degrees. Facet 177 has an azimuth of 348.25 degrees. The first side girdle facets are bounded on one side by corner girdle facet 210 having a slope of 90.00 degrees and an azimuth of 269.50 degrees. The first side girdle facets are bounded on the other side by corner girdle facet 211 having slope of 90.00 degrees and an azimuth of 359.50 degrees. Facets 171, 174 and 177 are preferably rectangular in shape, with facet 174 being substantially wider and taller than facets 171 and 177. Facet 177 is preferably the same size as facet 171. Facets 172, 173, 175 and 176 are preferably trapezoidal in shape, with facets 172 and 176 being mirror images of each other and facets 173 and 175 also being mirror images of each other. Facets 173 and 175 are substantially larger than facets 172 and 176.

Figure 4:
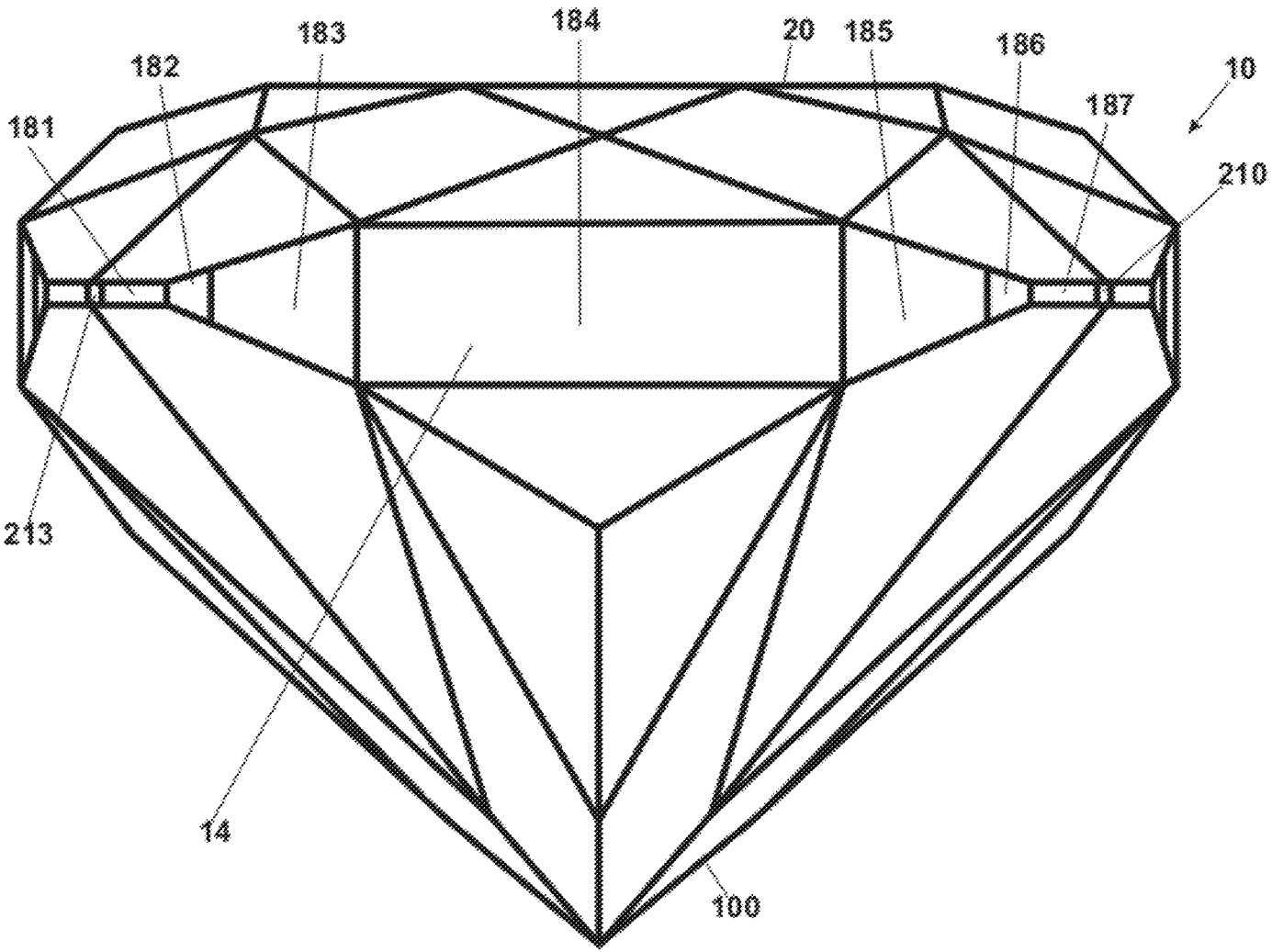
FIG. 4 is a second side view of the embodiment of a gemstone cut illustrated in FIG. 1.

Turning now to FIG. 4, it is seen that a girdle on one side 14 of the gemstone 10 is illustrated. Accordingly, girdle facet second sides 181, 182, 183, 184, 185, 186 and 187 are provided. The slope of the girdle facets are each 90.00 degrees. Facet 181 has an azimuth of 359.50 degrees. Facet 182 has an azimuth of 10.75 degrees. Facet 183 has an azimuth of 38.88 degrees. Facet 184 has an azimuth of 44.50 degrees. Facet 185 has an azimuth of 50.12 degrees. Facet 186 has an azimuth of 55.75 degrees. Facet 187 has an azimuth of 78.25 degrees. The second side girdle facets are bounded on one side by corner girdle facet 213 having a slope of 90.00 degrees and an azimuth of 348.25 degrees. The second side girdle facets are bounded on the other side by corner girdle facet 210 having slope of 90.00 degrees and an azimuth of 89.50 degrees. Facets 181, 184 and 187 are preferably rectangular in shape, with facet 184 being substantially wider and taller than facets 181 and 187. Facet 187 is preferably the same size as facet 181. Facets 182, 183, 185 and 186 are preferably trapezoidal in shape, with facets 182 and 186 being mirror images of each other and facets 183 and 185 also being mirror images of each other. Facets 183 and 185 are substantially larger than facets 182 and 186.

Figure 5:
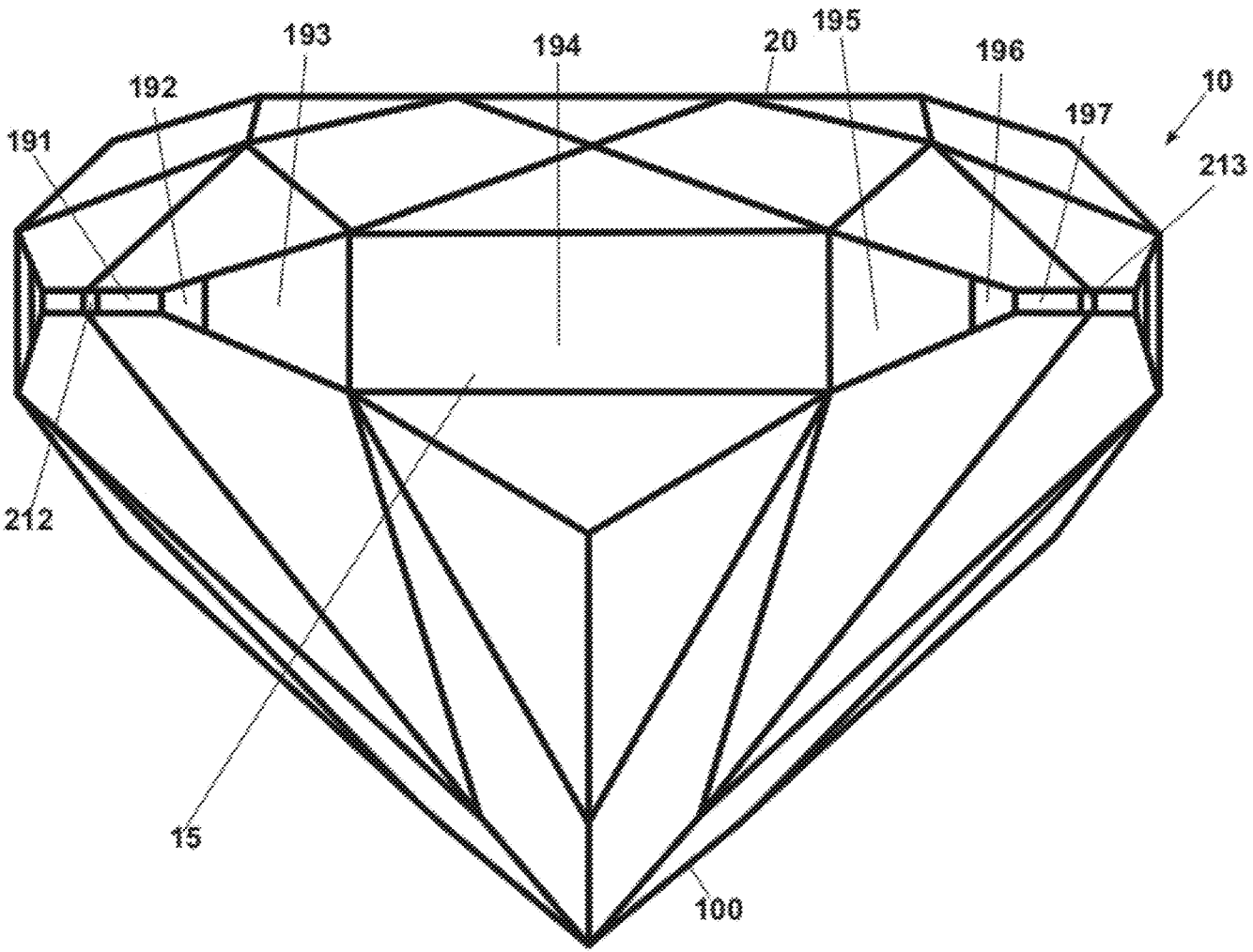
FIG. 5 is a third side view of the embodiment of a gemstone cut illustrated in FIG. 1.

Turning now to FIG. 5, it is seen that a girdle on one side 15 of the gemstone 10 is illustrated. Accordingly, girdle facet third sides 191, 192, 193, 194, 195, 196 and 197 are provided. The slope of the girdle facets are each 90.00 degrees. Facet 191 has an azimuth of 100.75 degrees. Facet 192 has an azimuth of 123.25 degrees. Facet 193 has an azimuth of 128.88 degrees. Facet 194 has an azimuth of 134.50 degrees. Facet 195 has an azimuth of 140.12 degrees. Facet 196 has an azimuth of 145.75 degrees. Facet 197 has an azimuth of 168.25 degrees. The third side girdle facets are bounded on one side by corner girdle facet 212 having a slope of 90.00 degrees and an azimuth of 89.50 degrees. The third side girdle facets are bounded on the other side by corner girdle facet 213 having slope of 90.00 degrees and an azimuth of 179.50 degrees. Facets 191, 194 and 197 are preferably rectangular in shape, with facet 194 being substantially wider and taller than facets 191 and 197. Facet 197 is preferably the same size as facet 191. Facets 192, 193, 195 and 196 are preferably trapezoidal in shape, with facets 192 and 196 being mirror images of each other and facets 193 and 195 also being mirror images of each other. Facets 193 and 195 are substantially larger than facets 192 and 196.

Figure 6:
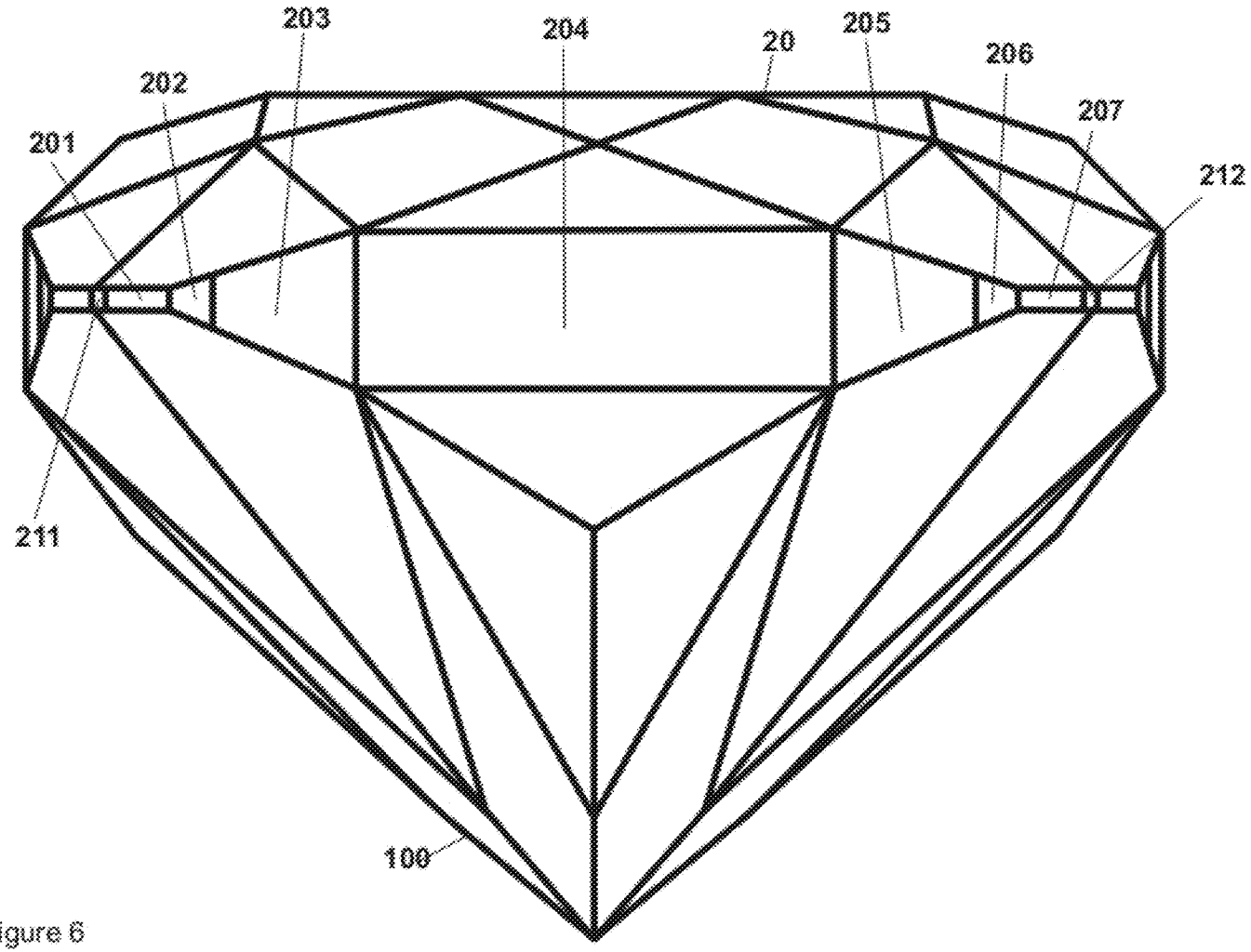
FIG. 6 is a fourth side view of the embodiment of a gemstone cut illustrated in FIG. 1.

Turning now to FIG. 6, it is seen that a girdle on one side 16 of the gemstone 10 is illustrated. Accordingly, girdle facet fourth sides 201, 202, 203, 204, 205, 206 and 207 are provided. The slope of the girdle facets are each 90.00 degrees. Facet 201 has an azimuth of 190.75 degrees. Facet 202 has an azimuth of 213.25 degrees. Facet 203 has an azimuth of 218.88 degrees. Facet 204 has an azimuth of 224.50 degrees. Facet 205 has an azimuth of 230.12 degrees. Facet 206 has an azimuth of 235.75 degrees. Facet 207 has an azimuth of 258.25 degrees. The fourth side girdle facets are bounded on one side by corner girdle facet 211 having a slope of 90.00 degrees and an azimuth of 179.50 degrees. The fourth side girdle facets are bounded on the other side by corner girdle facet 212 having slope of 90.00 degrees and an azimuth of 269.50 degrees. Facets 201, 204 and 207 are preferably rectangular in shape, with facet 204 being substantially wider and taller than facets 201 and 207. Facet 207 is preferably the same size as facet 201. Facets 202, 203, 205 and 206 are preferably trapezoidal in shape, with facets 202 and 206 being mirror images of each other and facets 203 and 205 also being mirror images of each other. Facets 203 and 205 are substantially larger than facets 202 and 206.

Overall, the gemstone 10 has four-fold mirror image symmetry. The length and the width of the gemstone 10 are preferable equal to each other. Accordingly, the gemstone 10 is preferably symmetrical in shape. The ratio of table width to overall width is about 0.575. The ratio of crown height to overall width is about 0.169. The ratio of pavilion height to overall width is about 0.552. The ratio of volume compared to a cubic dimension of overall width (a cube defined by all sides having a length equal to the overall width) is about 0.345.

Figure 7:
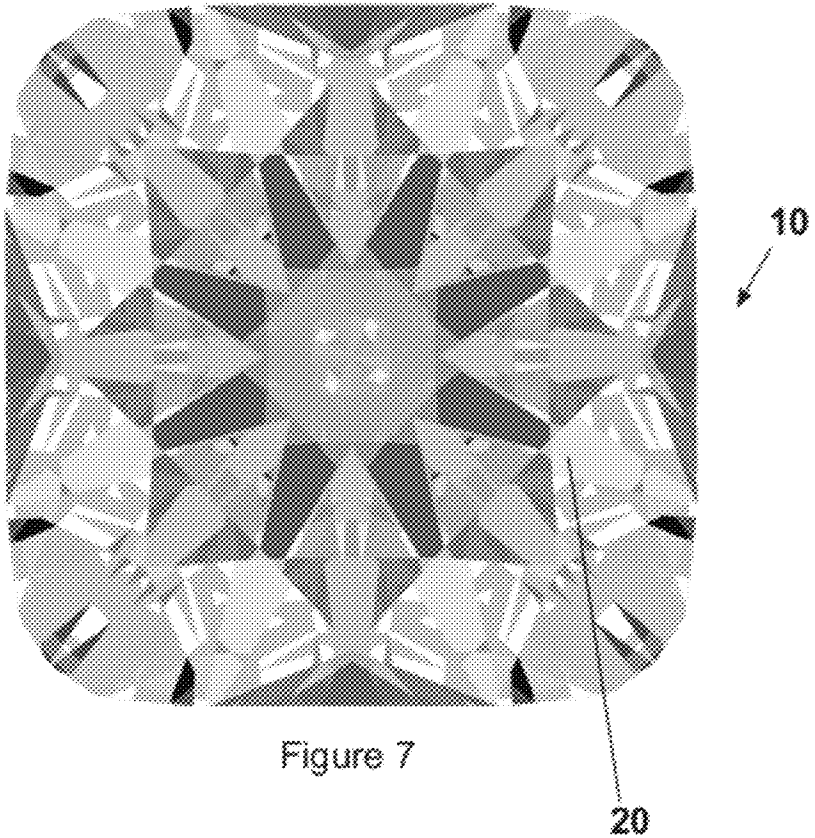
FIG. 7 is an ASET image of the embodiment of the present invention illustrated in FIG. 1.
Figure 15:
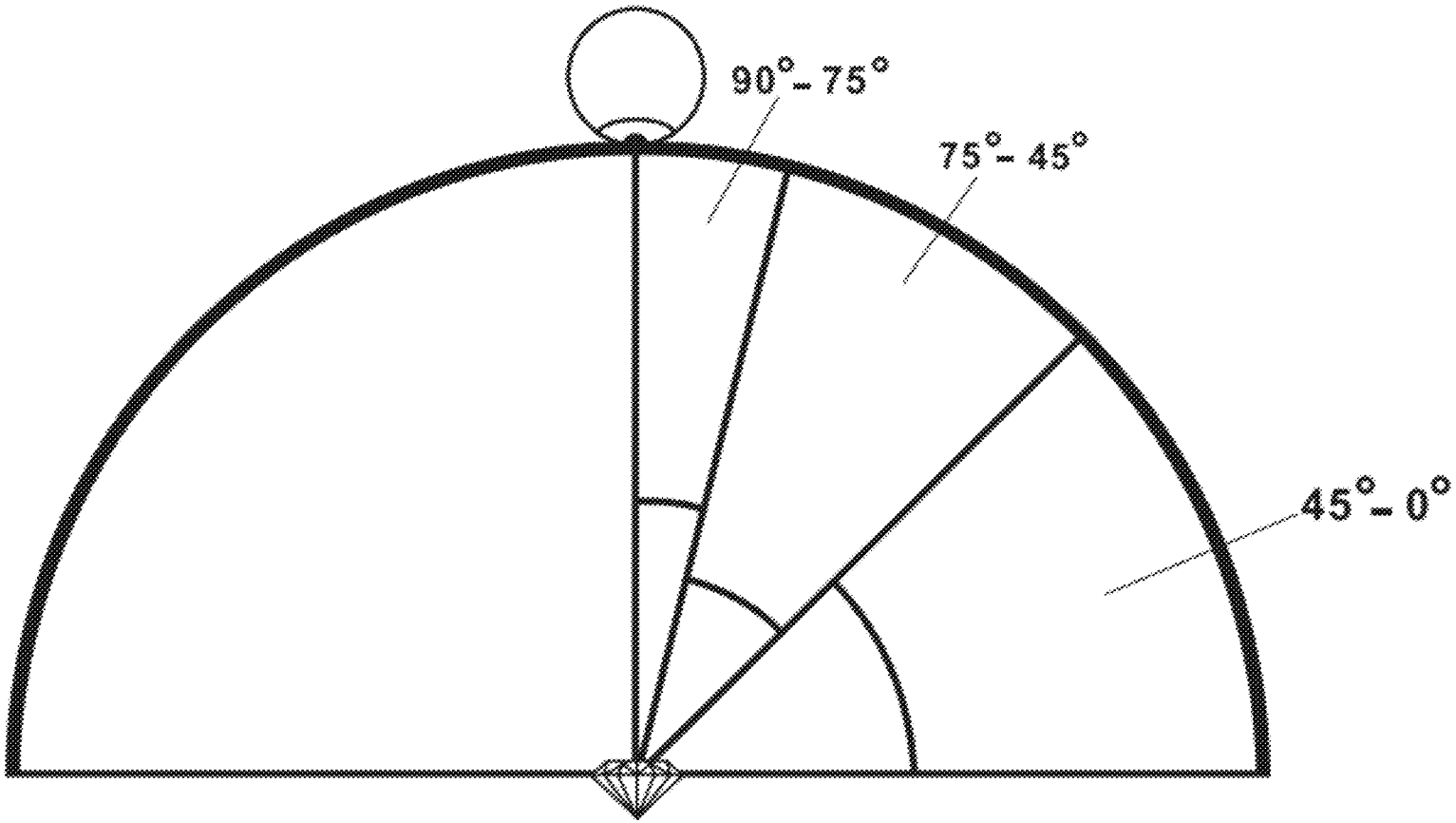
FIG. 15 is a side view illustrating the critical angles through which the present invention gathers light.
Figure 16:
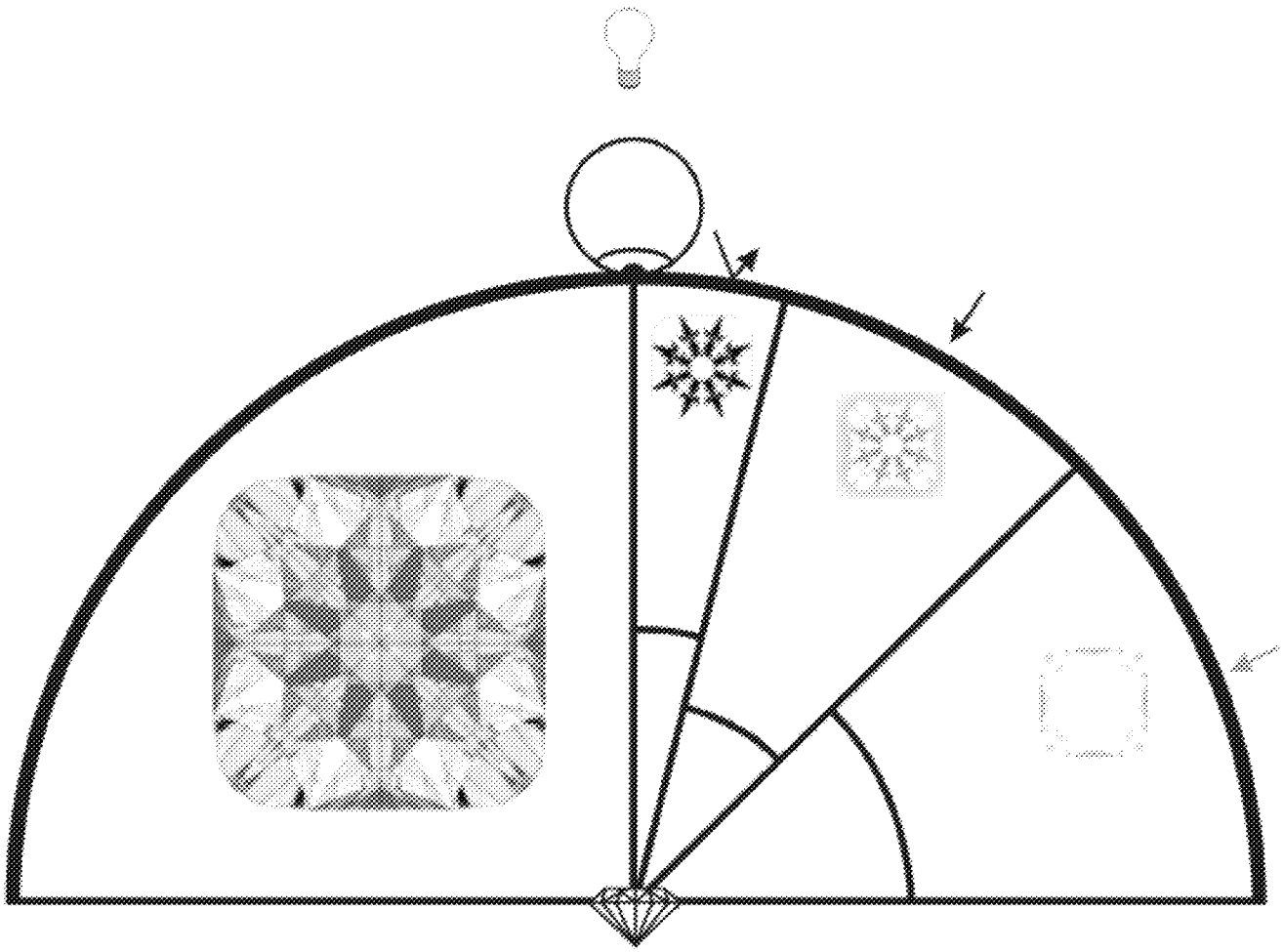

Turning now to FIG. 7, it is seen that an ASET (Angular Spectrum Evaluation Tool) image is provided illustrating the reflections that are apparent to the observer based on the external geometry described above. The combination of the facets on the gemstone 10 produces a unique pattern observable to the human eye which heretofore has been unachieved. In the ASET image, the contrast of the light next to the dark zones is perceived as brightness to the human eye. The bright areas are directly attributable to light that comes from 75 degrees to 45 degrees. The less intense areas are from 45 degrees to the horizon (and represent only about 14% of the total face of the stone). The diamond is designed to minimize these less intense areas. The dark areas provide the contrast necessary for brightness to be perceived and contribute to scintillation. These areas gather from 75 degrees to 90 degrees (normal), which is essentially a 30 degree obscuration (15 degrees on both sides of normal). This 30 degree obscuration is what takes place in the human eye during observation when a diamond is approximately 9.84 inches away. These areas are illustrated in FIGS. 15 and 16.

Figure 8:
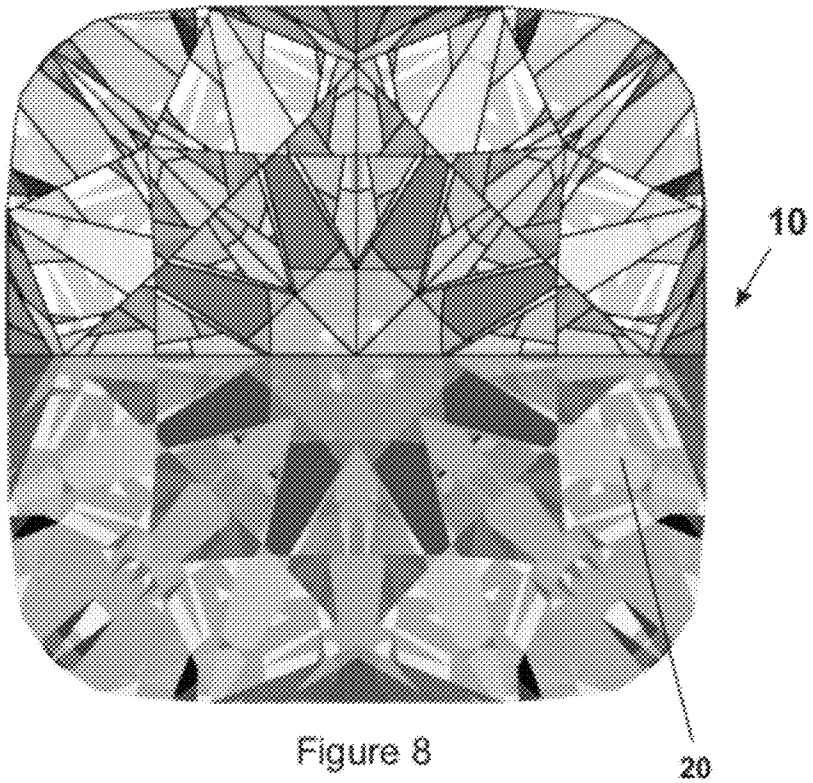
FIG. 8. is similar to FIG. 7, but includes an overlay on the top half of the figure illustrating a virtual facet pattern created by the geometry of the present invention.
Figure 10:
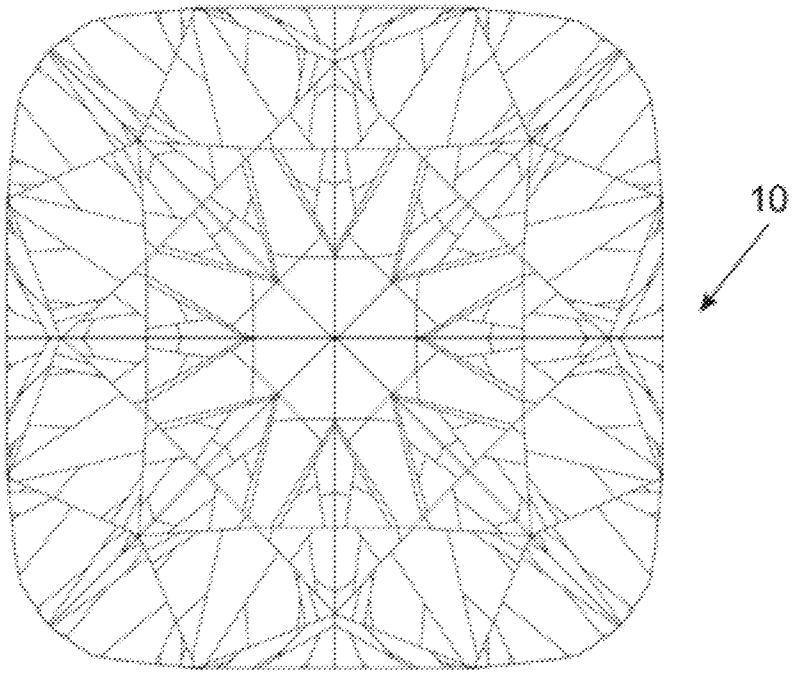
FIG. 10 is a top view illustrating a complete virtual facet pattern created by the geometry of the present invention.
Figure 9:
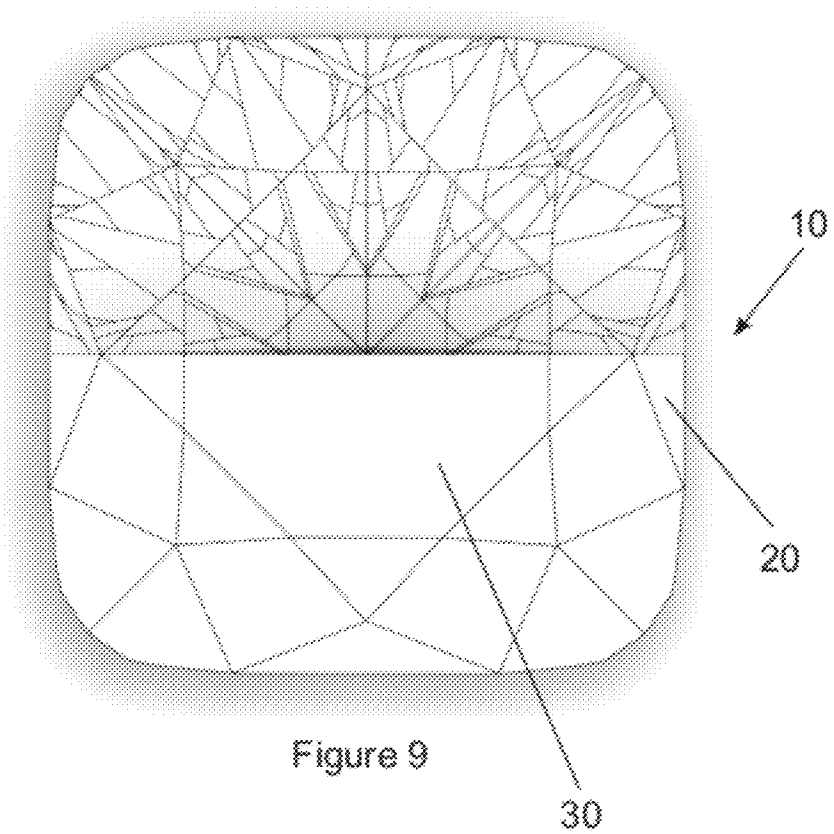
FIG. 9 is a top view illustrating actual crown facets on the bottom half and virtual facets illustrated on the top half.
Figure 12:
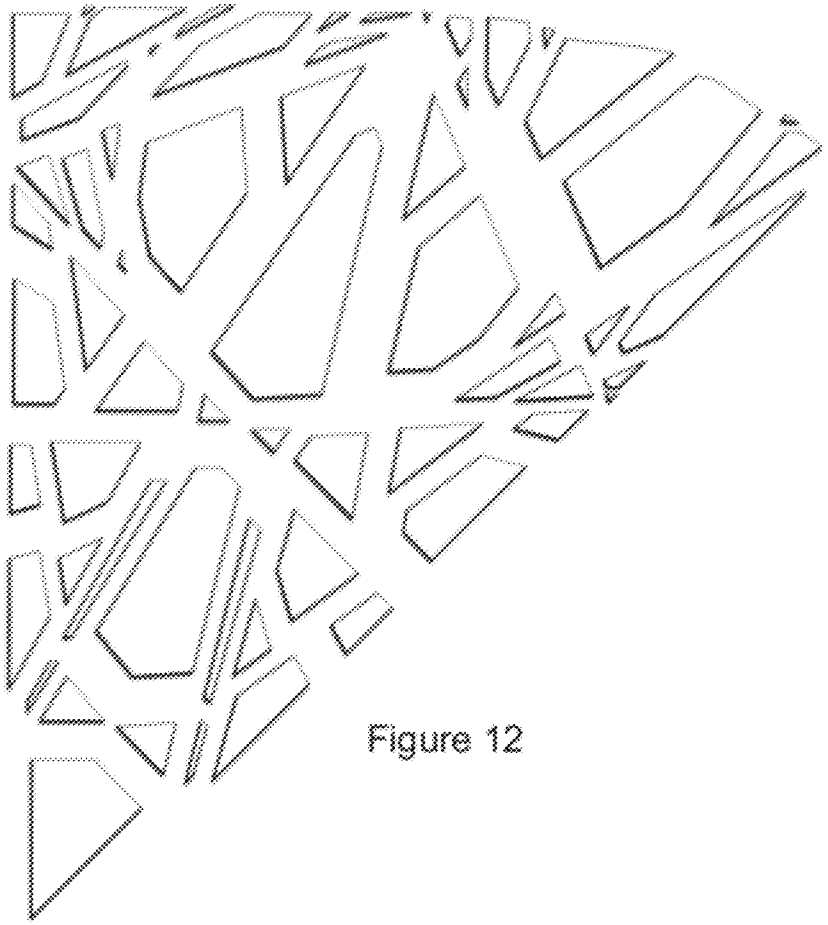
FIG. 12 is an exploded view of FIG. 11.
Figure 11:
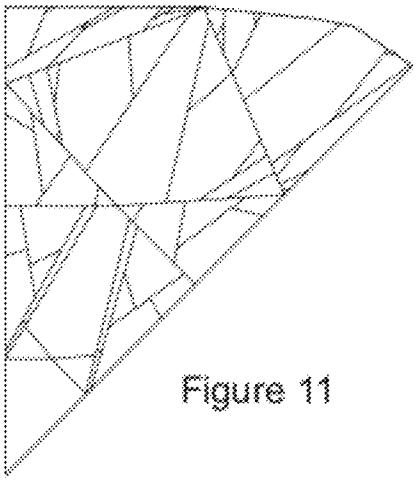
FIG. 11 is an isolation view showing ⅛ of the top view.

FIG. 8 shows a partial overlay of virtual facets that are the result of the above-described facets. The virtual facets each represent light reflections of the gemstone 10. FIG. 9 is similar to FIG. 8, but shows the overlay over the crown 20 of the gemstone 10. FIG. 10 is a top view of the virtual facets observed on the crown. It is seen that the virtual facets are divided into eight alternating mirror images. FIG. 11 is an isolation view of one of these eight sections and FIG. 12 is an exploded view showing the virtual facets.

Figure 14:
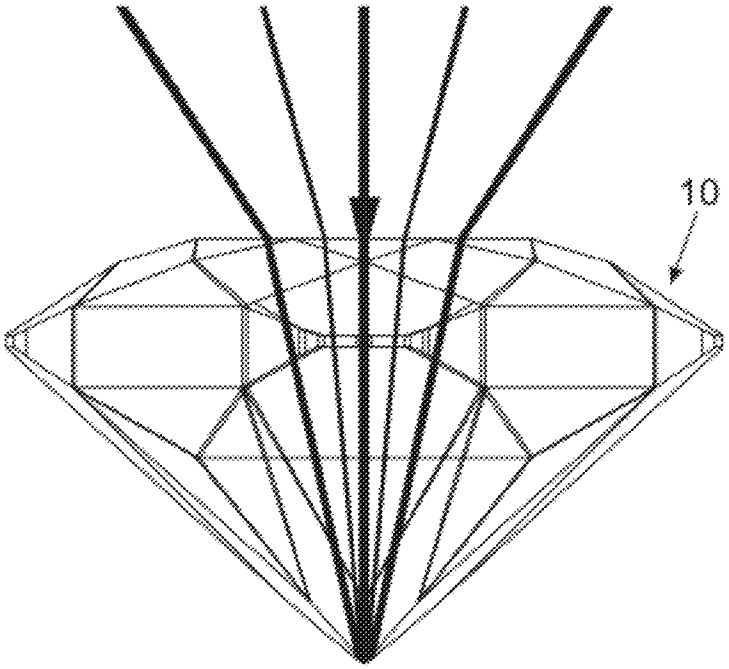
FIG. 14 is a side view showing a ray tracing image of a ray entering the crown, being reflected in the pavilion and exiting multiple locations of the crown.
Figure 13:
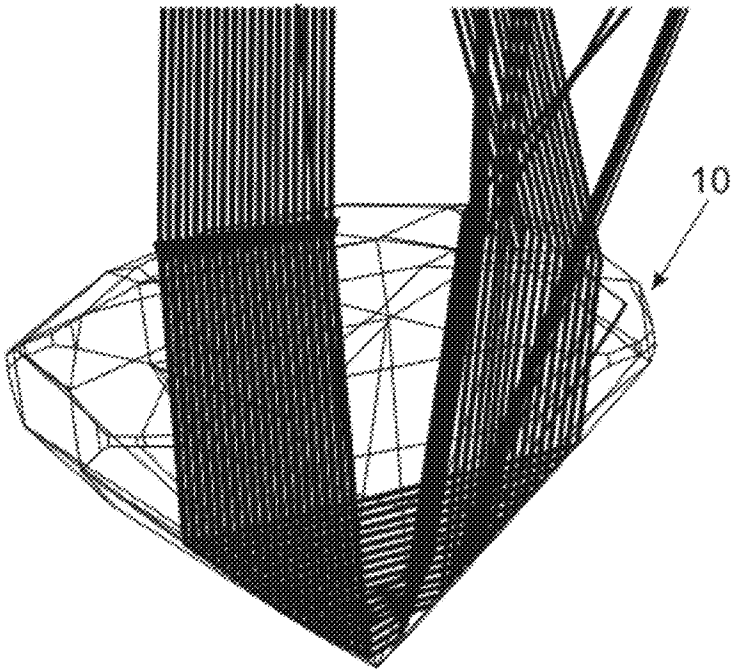
FIG. 13 is a perspective view showing a multiple ray tracing image of rays entering the crown, being reflected in the pavilion and exiting the crown.

FIG. 13 illustrates multiple line tracing image showing how light enters the crown, is reflected by the pavilion and exits from the crown with no leakage out from the pavilion. FIG. 14 shows a single ray tracing entering the table, reflecting off from the pavilion and exiting the crown (again with no light leaking from the pavilion).

Thus it is apparent that there has been provided, in accordance with the invention, a gemstone cut with improved characteristics that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A gemstone comprising:

a crown having exactly 29 crown facets and four corners, said crown comprising one table facet that is an octagonal shape;

four first star facets;

four second star facets, wherein said four first star facets and said four second star facets are in an alternating arrangement and each are immediately adjacent said one table facet;

eight kite facets;

eight first upper girdle facets; and four second upper girdle facets wherein one of each of said four second upper girdle facets is located midway between two of said four corners;

a pavilion having 28 pavilion facets, said pavilion comprising:

eight primary pavilion facets;

eight intermediate pavilion facets being arranged in pairs;

eight first lower girdle facets being arranged in pairs; and four second lower girdle facets being equally spaced apart; and a girdle having exactly 32 girdle facets, said girdle comprising:

four sides each having seven facets; and four girdle corner facets, wherein:

the slope of each of said seven facets of each of said four sides has a slope of approximately 90 degrees, an amount of light entering through said crown is reflected by said pavilion and exits from said crown, wherein in an area of approximately 14% of said crown a portion of said amount of light that exits from said crown does so at an angle between about 45 degrees and horizontal, and said crown, said pavilion and said girdle provide a unique pattern.

2. The gemstone of claim 1 wherein said crown has a crown height and said gemstone has a gemstone height, said gemstone having a ratio of said crown height to said gemstone height, the ratio of said crown height to said gemstone height being approximately 0.169.

3. The gemstone of claim 1 wherein said pavilion has a pavilion height and said gemstone has a gemstone width, said gemstone having a ratio of said pavilion height to said gemstone width, the ratio of said pavilion height to said gemstone width being approximately 0.552.

* * * * *